US005755327A

United States Patent [19]

Saltzman et al.

[11] Patent Number: 5,755,327

[45] Date of Patent: May 26, 1998

[54] DECORATIVE PACKAGE

[75] Inventors: Ruth Saltzman; Heidi Rickabaugh, both of Beaverton, Oreg.

[73] Assignee: Monsanto Company, St. Louis, Mo.

[21] Appl. No.: 785,922

[22] Filed: Jan. 21, 1997

Related U.S. Application Data

[63] Continuation-in-part of Ser. No. 61,836, Oct. 30, 1996.

[51] Int. Cl.[6] ..... B65D 25/10

[52] U.S. Cl. ..... 206/457; 206/423; 206/459.5; 206/775

[58] Field of Search ..... 206/457, 423, 206/521, 521.2, 521.6, 521.7, 462, 469, 528, 588, 776, 383, 775, 312, 459.5

[56] References Cited

U.S. PATENT DOCUMENTS

| | | | |
|---|---|---|---|
| 2,456,610 | 12/1948 | Baker | 206/776 |
| 2,498,757 | 2/1950 | High | 206/776 |
| 2,518,711 | 8/1950 | Mulford . | |
| 2,790,257 | 4/1957 | Ware . | |
| 3,161,339 | 12/1964 | Weller | 206/521 |
| 3,240,417 | 3/1966 | Andreini | 206/588 |
| 4,014,134 | 3/1977 | Womack . | |
| 4,094,405 | 6/1978 | Ruger . | |
| 4,418,497 | 12/1983 | Mastriano . | |
| 4,534,125 | 8/1985 | Buck . | |
| 5,158,809 | 10/1992 | Proctor . | |
| 5,358,101 | 10/1994 | Lombardi | 206/776 |
| 5,379,886 | 1/1995 | Brauner et al. | 206/462 |
| 5,582,293 | 12/1996 | Kay | 206/457 |
| 5,600,628 | 2/1997 | Spector | 206/312 |

*Primary Examiner*—Ted Kavanaugh
*Assistant Examiner*—Luan K. Bui
*Attorney, Agent, or Firm*—Kolisch, Hartwell, Dickinson, McCormack & Heuser

[57] ABSTRACT

A decorative package for a product, the package including a container for releasably holding the product. A sheet-like decorative collar is mounted on the container, and the container and collar are held within the box. The collar has a central opening with edge segments that conform to the container, and the collar is mounted on the container by interposing the container between the conforming edge segments of the central opening. At least two portions of the box operatively contact the collar so that the container is held within a substantially predefined region within the box. The collar extends outwardly from the container in a single plane that substantially bisects the container. The bisection of the container by the single plane is visually perceivable from outside the box.

15 Claims, 3 Drawing Sheets

DECORATIVE PACKAGE

CROSS REFERENCE TO RELATED APPLICATIONS

This application is a continuation-in-part of U.S. design patent application Ser. No. 29/061,836, filed on Oct. 30, 1996, entitled DECORATIVE PACKAGING FOR A PRODUCT incorporated herein by reference.

BACKGROUND AND SUMMARY OF THE INVENTION

The present invention relates generally to packages for products and more specifically to decorative packages for seeds. The package itself is a visually pleasing article that meets the growing need for a way to present products like seeds in a device that makes a substantial visual impact while safeguarding the contents of the package.

Conventional seed packages are simple envelopes into which the seeds are placed, and the envelope then is sealed. Printed information on the outside of the envelope often includes a graphic representation of the plant that will grow from the seeds, and instructions on the proper planting of the seeds. These conventional seed envelopes are satisfactory for many applications. However, with the growing interest in gardening, there is an increased demand for high quality seeds and high quality packaging. High quality packaging for seeds protects the seeds from damage and improves consumer impressions of the quality of the seeds.

It has been found that the there is a substantial market demand for carefully selected collections of seeds, and that consumers often purchase such seed collections as gifts. Conventional seed envelopes need to be further packaged if they are to be sold as part of a seed collection. Furthermore, conventional seed envelopes do not have the favorable visual impact of the package according to the invention.

Some attempts have been made to meet the need for a protective and impressive package for seeds. For example, shaker cans similar to the cans used for spices or domestic chemicals have a large surface area on which decorative printing may be applied. These cans make more of a visual impact than a simple seed envelope. Another type of packaging commonly used is a small wooden crate into which seed envelopes, shaker cans, and/or various gardening accessories are placed. The crate presents the seed envelopes and various accessories for viewing, much as produce would be presented in a crate at a farmer's market.

The present invention in its various embodiments provides a substantially improved visual impression for a package for products like seeds. It includes a container and a stiff decorative collar mounted on the container. Collectively, the container and decorative collar represent the shape of a flower or other object produced by the seeds. The container and collar may be packaged in a transparent box through which the flower-like properties of the container/collar combination are easily observed by a consumer or gift recipient. The collar is made of stiff material like cardboard so that the collar holds the container in a predefined region within the transparent box.

In alternative embodiments, the collar may be shaped to represent other images, such as vegetables or plant leaves. The collar may even be shaped like an artist's palette to represent a collection of seeds that will produce flowers of a wide variety of colors, evoking a mental image of the paints that would be found on an artist's palette.

It is an object of the invention to provide a package for a product that is visually impressive and evocative of the nature of the product contained by the package.

Another object of the invention is to provide high quality packaging which will safeguard the contents of the packaging.

It also is an object of the invention to provide a package to represent the type of flowers or plants that will grow from the product, in the case of seeds.

It further is an object of the invention to provide a flower-shaped element for holding seeds, contained within a transparent box.

Additional objects and advantages of the present invention will be understood more readily after a consideration of the drawings and the Detailed Description of the Preferred Embodiment.

DETAILED DESCRIPTION OF THE PREFERRED EMBODIMENT

Figure 1:
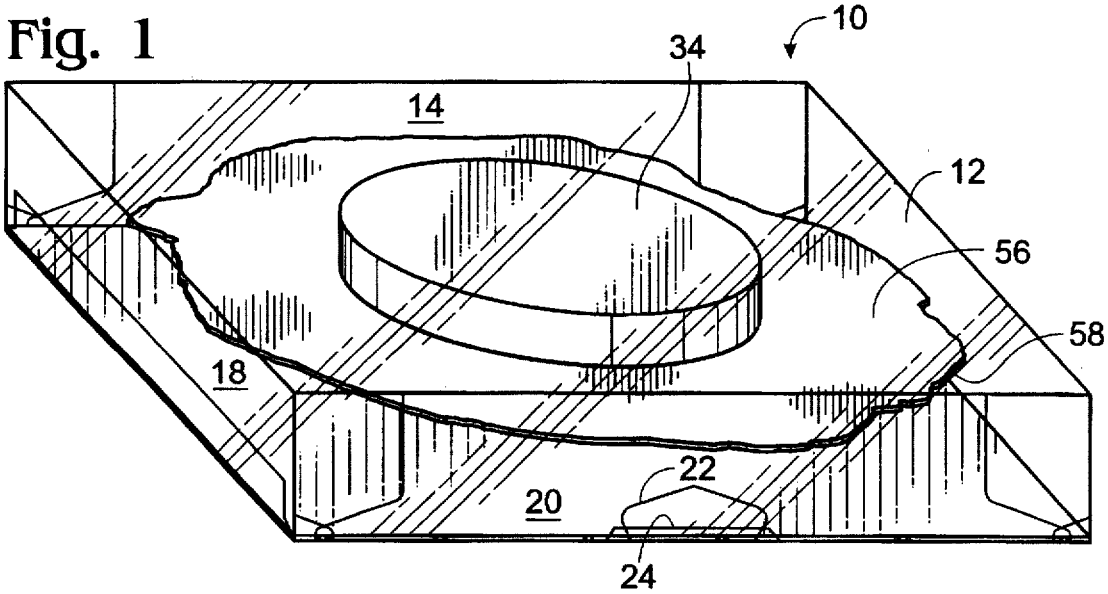
FIG. 1 is an isometric view of a decorative package according to the present invention, showing the preferred embodiment.

A package according to the present invention is indicated generally in the drawings at 10. The components of package 10 will be described in detail below, with reference characters identified for the components as they are discussed. The principal components include a box, a container, a collar mounted on the container, and a backing card. The container/collar combination and backing card are held in the box, with the backing card placed between the container and a portion of the box.

The box, indicated in the drawings at 12, preferably is transparent, forming a see-through outer covering for package 10. For ease of reference, a top 14, a bottom 16, fixed sides 18 and front and rear flaps 20 are labeled in FIGS. 1 through 4. Any or all of these portions 14 through 20 of box 12 provide opposing surfaces 14 through 20 between which other elements of package 10 may be held.

Figure 2:
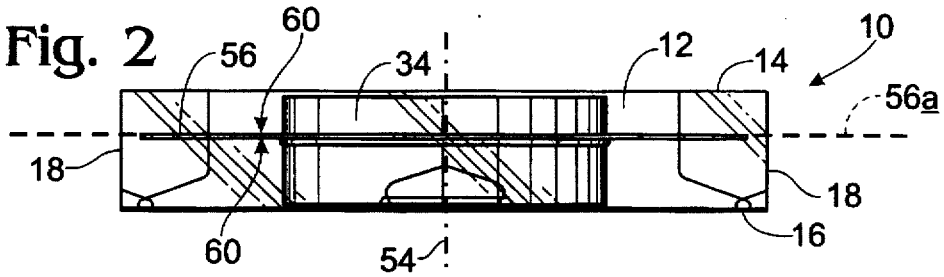
FIG. 2 is an elevation of the embodiment shown in FIG. 1, taken from the front with respect to FIG. 1 and shown on a smaller scale than in FIG. 1.

Box 12 may be closed and opened using any conventional method. Preferably, flaps 20 are releasably closed by a tab 22 that extends outwardly from bottom 16 and fits into a matching slot 24 formed in flap 20, as shown in FIGS. 1 and 2. This provides a recloseable fastener for package 10. Alternatively, a more permanent type of fastener may be used, such as adhesive applied to overlapping portions of box 12, but this may limit the reusability of package 10 by the consumer. Reusability of package 10 adds to its value to the consumer, and is thus a desired feature.

Figure 4:
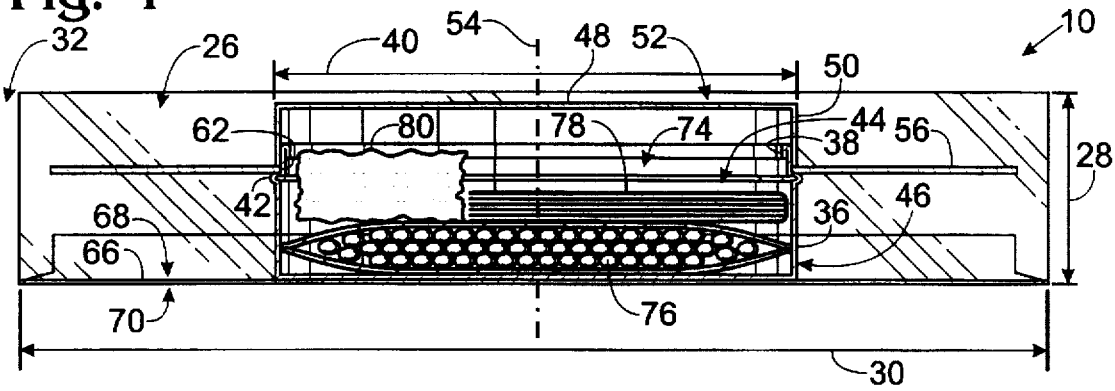
FIG. 4 is a cross-sectional view of the embodiment shown in FIG. 1, taken generally along line 4—4 in FIG. 3, and shown on a larger scale than in FIG. 1.

Opposing surfaces 14 through 20 collectively define a hollow interior 26 within box 12, as indicated generally in FIG. 4. Also shown in FIG. 4 is a first box dimension 28 defined between opposing surfaces 14 and 16, and a second box dimension 30 defined between opposing surfaces 20, measuring two of an infinite number of outer limits of hollow interior 26. Hollow interior 26 is the inside of box 12. An outside, without box 12, is indicated generally at 32.

The container is indicated in the drawings at 34, and is preferably a canister of the type shown in FIG. 4 that is easily opened and closed. Canister 34 includes a body or bottom 36 with a lip 38 that defines a first canister dimension 40. A ridge 42 is formed adjacent lip 38 for reasons described in detail below. Body 36 defines a product-receiving cavity 44 and an outer surface 46.

A lid 48 mounts onto lip 38, closing container 34 and providing a top for container 34. Lid 48 preferably includes a wall 50 that mates with lip 38 to seal product-receiving cavity 44. Outer surfaces 52 are defined by lid 48, as indicated.

Preferably, container 34 is sized relative to box 12 so that at least two outer portions, such as surfaces 46 and 52, conform to box 12, for example first box dimension 28. Container 34 also is sized so that box 12 is substantially larger than container 34 in at least one dimension, for example second box dimension 30. Box 12 encompasses container 34, with at least two portions of box 12, such as surfaces 14 and 16, operatively contacting at least two portions of container 34, such as surfaces 46 and 52, respectively. The partial conformance between box 12 and container 34 helps keep lid 48 on body 36 when container 34 is placed within box 12. The substantially larger dimension 30 relative to container 34 allows room for decorative items, as described below.

In the embodiment shown in the drawings, container 34 is symmetrical about an axis of symmetry 54. Axis of symmetry 54 coincides with axes of symmetry of both body 36 and lid 48, when body 36 is mated with lid 48 to create container 34. Alternatively, an asymmetrical container may be used, but this alternative embodiment is not shown in the drawings.

Returning to FIG. 1, the collar of package 10 is indicated at 56. Collar 56 is preferably made of sheet-like, stiff material such as cardboard, plastic, or metal. Preferably, collar 56 extends substantially in a single plane, referred to as collar plane **56*a*, extending into and out of the sheet with respect to FIG. 2. Collar 56 is at least partially defined by a perimeter 58 that generally is curvilinear in shape and, more specifically, flower-shaped. In alternative embodiments, perimeter 58** may be shaped to suggest other aspects of the seeds, as discussed above with respect to vegetable and artist's palette shapes.

Figure 5:
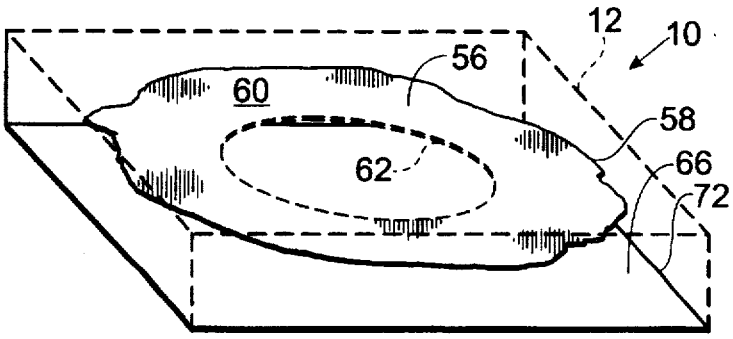
FIG. 5 is an isometric view of the collar of the package shown in FIG. 1, with a box shown in dashed lines for reference.

Collar 56 may be further defined by opposing faces 60 extending between perimeter 58, shown best in FIG. 2, and a central opening 62, shown best in FIG. 5. Central opening 62 preferably conforms to lip 38 so that collar 56 may be placed onto lip 38 and then mounted on container 34 by being sandwiched between lid 48 and body 36, as shown best in FIG. 4. When so mounted, collar 56 thus extends outwardly from container 34 in a single plane **56*a* that preferably substantially bisects container 34 and extends substantially perpendicular to axis of symmetry 54, as shown best in FIG. 2**.

Figure 3:
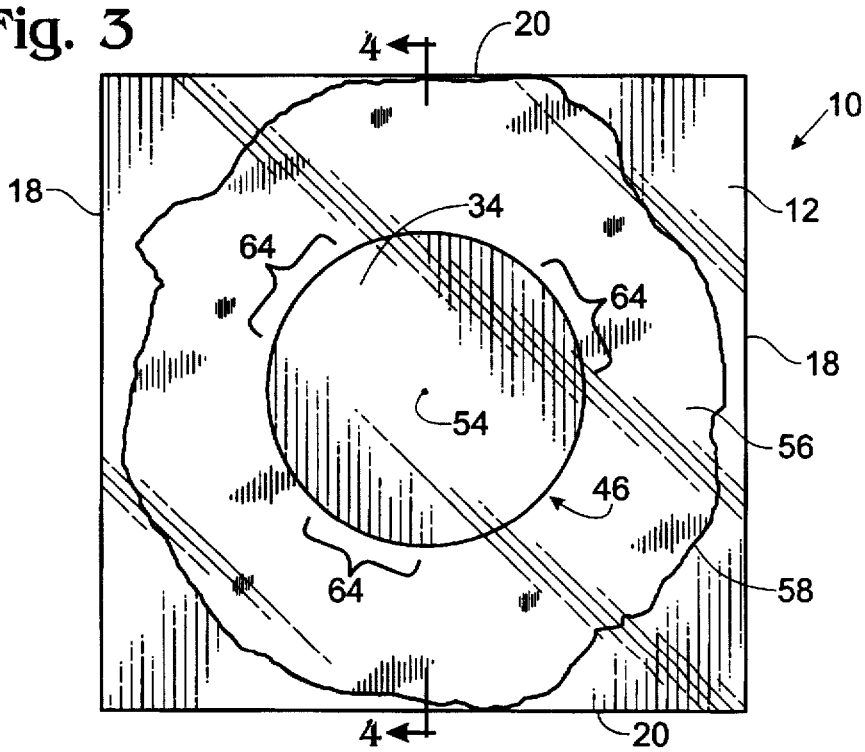
FIG. 3 is a top plan view of the embodiment shown in FIG. 1, shown on about the same scale as in FIG. 2.

The bisection of container 34 by collar plane **56*a* is visually perceivable from outside box 12, as shown in FIGS. 2 and 3. This visual bisection need not coincide with the actual bisection of container 34 into body 36 and lid 48. Thus, the visual bisection provides an alternative or concurrent definition of a top of container 34 on one side of single plane 56*a* and a bottom of container 34 on the other side of single plane 56*a*. Both the top and bottom of container 34 preferably are continuously visible from a viewpoint within single plane 56*a* and immediately outside box 12 relative to container 34 as the viewpoint is moved through a complete 360-degrees of travel around box 12 and within single plane 56*a*. In certain undepicted alternative embodiments of box 12, the bisection of container 34 by single plane 56*a* may be visible from only a few viewpoints within single plane 56*a*, substantially distributed around outside 32 of box 12**.

Ridge 42 improves the retention of collar 56 by preventing central opening 62 from passing over body 36. Central opening 62 is shown in all of the embodiments as substantially conforming to outer surfaces 46 of body 36. However, it will be understood that collar 56 may be mounted on container 34 by merely a few edge segments 64 of collar 56, as labeled in FIG. 3, that would conform to corresponding portions of container 34. Container 34 is interposed conforming edge segments 64.

In the complete package 10, both container 34 and collar 56 are encompassed by box 12. At least two portions of box 12, such as surfaces 18 and/or 20, operatively contact portions of outer perimeter 58 of collar 56 so that container 34 is held within a substantially predefined region within box 34. Furthermore, collar 56 is held by container 34 so that opposing faces 66 do not make substantial direct contact with box 12, as shown best in FIG. 2.

An optional sheet-like backing card 66 is indicated in FIG. 4, preferably made of conventional cardboard sheet stock similar to that used for collar 56. A top 68 of card 66 is identified, as is a bottom 70. Top 68 of backing card 66 provides a visual background to canister 34 and collar 56, particularly when top 68 is colored to contrast visually with the coloring of collar 56. Planting instructions and product information may be placed on bottom 70 of card 66.

Card 66 includes a perimeter 72, and at least two portions of perimeter 72 approximately conform to at least two of the opposing surfaces 14 through 20 of box 12, such as surfaces 18 and/or 20. Card 66 may then be held within a substantially predefined region of hollow interior 26 of box 12 by being sandwiched between an outer surface of container 34, such as surface 46, and one of the opposing surfaces 14 through 20, such as bottom surface 16.

A product 72 is shown in FIG. 4, removably held by package 10. More specifically, product 72 is releasably held by container 34, which in turn is removably held in hollow interior 26 of box 12. Product 72 preferably includes seeds 74, various growing materials 76, and/or other accessories such as an instruction book 76 and a compressed growing pellet 78.

Several examples of alternative embodiments of package 10, showing ornamental designs within the scope of the invention as described and claimed herein, are shown in FIGS. 6 through 11. The packages of FIGS. 6 through 11 are identified as items 110, 210, 310, 410, and 510, respectively. It will be understood that the ornamental features of these embodiments may be combined and deleted as desired to produce numerous other embodiments equally within the scope of the appended claims.

Figure 6:
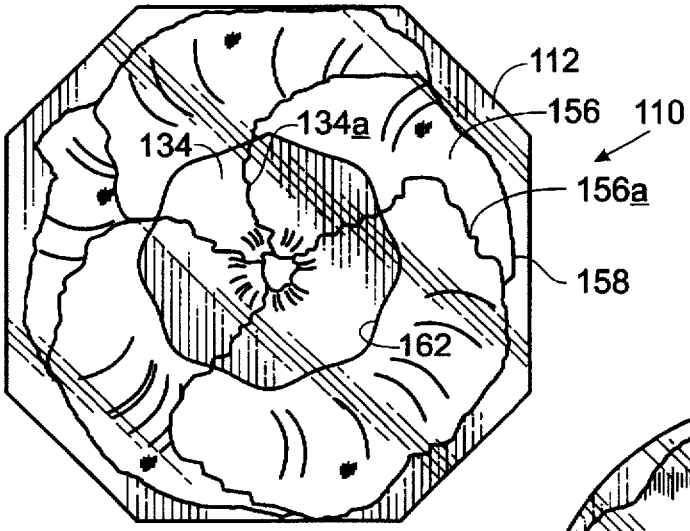
FIG. 6 is a top plan view of an alternative embodiment of the invention shown in FIG. 1, showing possible changes in the ornamental design of the package shown in FIG. 1.

In FIG. 6, box 112 is shown octagonally shaped, as is canister 134. Canister 134 and collar 156 are shown with lines 134*a* and 156*a*, respectively, representing individual petals of a pansy-like flower. In the preferred embodiment, lines 134*a* and 156*a* are part of a color graphic or photo of a flower, and perimeter 158 is cut to conform to the outer limits of the flower. Accordingly, collar 156 and canister 134 each includes a graphic design and, as shown in FIG. 6, the graphic design on collar 156 is aligned with and continued by the graphic design on canister 134 so that a unitary graphic image such as the flower shown in FIG. 6 is created thereby.

Figure 7:
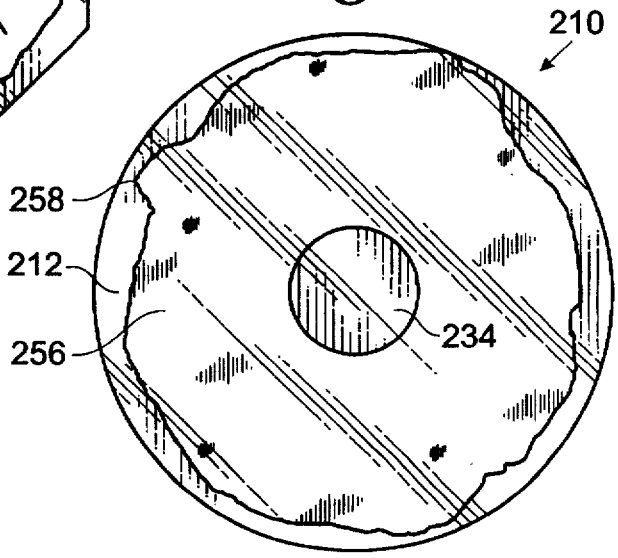
FIG. 7 is a top plan view of another alternative embodiment of the invention shown in FIG. 1, showing other possible changes in the ornamental design of the package shown in FIG. 1.
Figure 8:
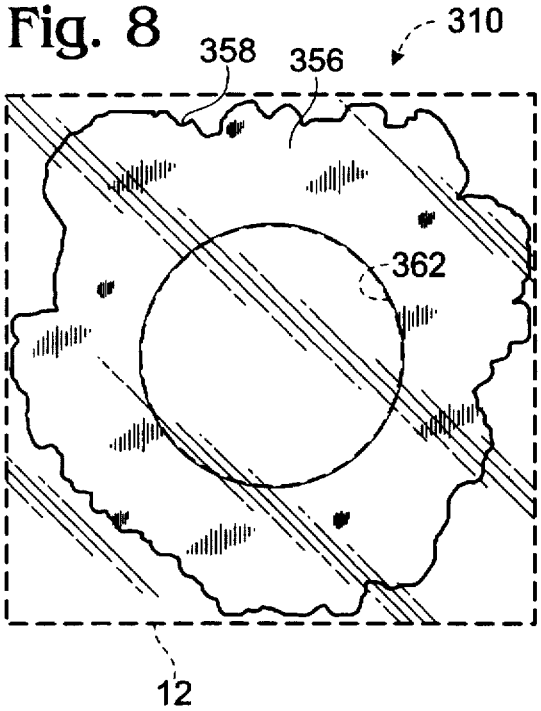
FIG. 8 is a top plan view of another alternative embodiment of the invention shown in FIG. 1, showing other possible changes in the ornamental design of the package shown in FIG. 1.

In FIG. 7, box 212 and container 234 are round, and container 234 is much smaller in proportion to box 212 than those shown in FIGS. 1 through 6. Collar 256 has an outer perimeter 258 that is pansy-shaped, as shown in FIGS. 1 through 6. In FIG. 8, box 312 is square, and collar 356 has a poppy-shaped perimeter and a large circular opening 362.

Figure 9:
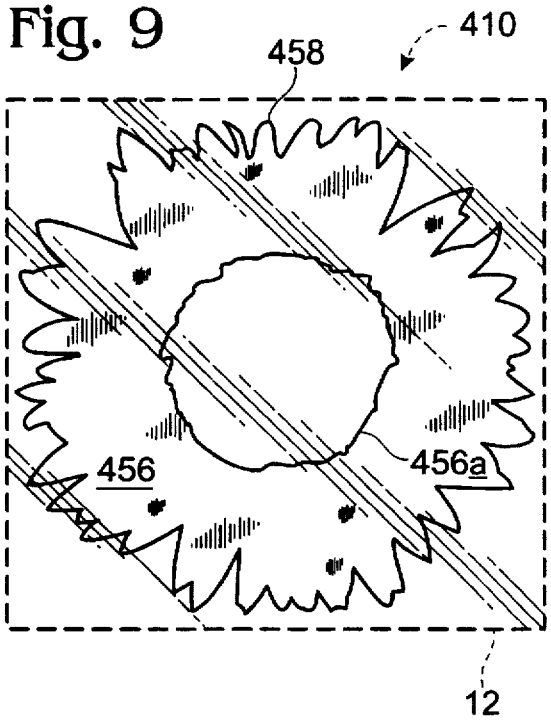
FIG. 9 is a top plan view of another alternative embodiment of the invention shown in FIG. 1, showing other possible changes in the ornamental design of the package shown in FIG. 1.
Figure 10:
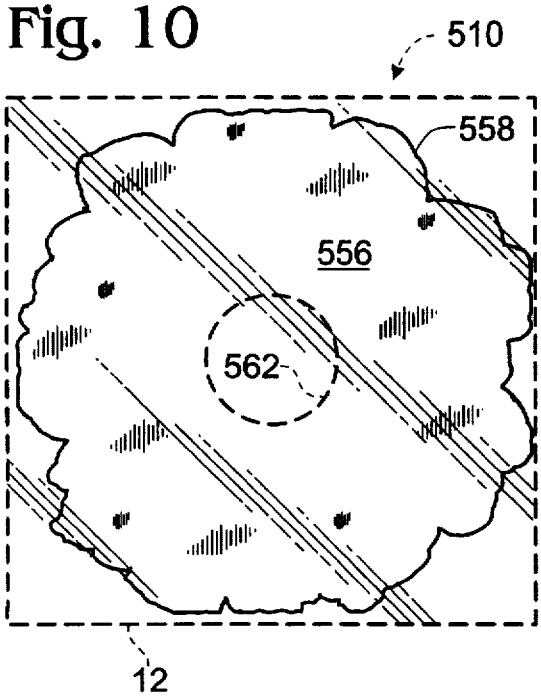
FIG. 10 is a top plan view of another alternative embodiment of the invention shown in FIG. 1, showing other possible changes in the ornamental design of the package shown in FIG. 1.
Figure 11:
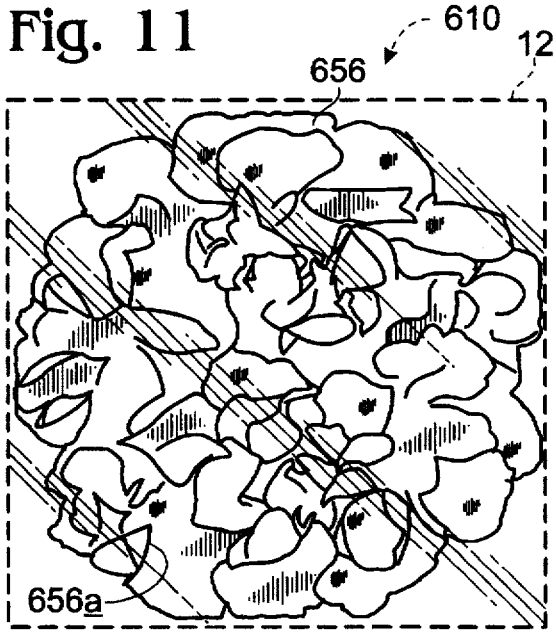
FIG. 11 is a top plan view of another alternative embodiment of the invention shown in FIG. 1, showing other possible changes in the ornamental design of the package shown in FIG. 1.

A sunflower-shaped collar 456 is shown in FIG. 9, with a sunflower-shaped perimeter 458. Lining 456*a* represents the darker seed portion of the sunflower and no central opening is included in collar 456. FIG. 10 shows collar 556 with a bouquet-shaped perimeter 558 and a smaller central opening 562. The details of the bouquet are shown in FIG. 11, with collar 656 including lining 656*a* to represent a bouquet of sweet pea blossoms.

Other alternative embodiments that are not shown in the drawings include embodiments in which container 34, collar 56 and/or card 66 are at least partially transparent.

From the foregoing identification of the elements of the preferred and alternative embodiments, numerous different embodiments may be described. Thus, while the present invention has been shown and described by reference to selected embodiments, it will be apparent to those skilled in the art that other changes in form and detail may be made therein without departing from the spirit and scope of the appended claims.

We claim:

1. A decorative package for a product, comprising:

a container for releasably holding the product;

a substantially planar, decorative collar mounted on the container; and a transparent box within which the container and collar are held;

wherein:

the container has a body with a lip, and a lid that mounts onto the lip thereby substantially closing the container;

the collar is defined by an outer perimeter and two opposing faces extending between the perimeter;

the collar is mounted on the container by being placed onto the lip and sandwiched between the body and the lid; and the collar is held by the container so that the opposing faces of the collar do not make substantial contact with the box.

2. The decorative package according to claim 1, further comprising a backing card held within the box, between the container and the box.

3. The decorative package according to claim 2, wherein the card is at least partially transparent.

4. The decorative package according to claim 1, wherein the container is at least partially transparent.

5. The decorative package according to claim 1, wherein the collar is at least partially transparent.

6. The decorative package according to claim 1, wherein the box operatively contacts portions of the outer perimeter of the collar.

7. The decorative package according to claim 1, wherein:

at least two portions of the box operatively contact at least two portions of the container; and at least two additional portions of the box operatively contact the collar so that the container is held within a substantially predefined region within the box.

8. A package for holding seeds, comprising:

a container defining a seed-receiving cavity;

a stiff collar extending outwardly from the container in a single plane, the collar being defined by two opposing faces extending between an outer perimeter, the single plane of the collar substantially bisecting the container; and a box encompassing both the container and the collar, the box defining an inside within the box and an outside without the box, wherein the bisection of the container by the single plane of the collar is visually perceivable from outside the box;

wherein:

the container has a body with a lip, and a lid that mounts onto the lip thereby substantially closing the container; and the collar is mounted on the container by being placed onto the lip and sandwiched between the body and the lid; and the collar is held by the container so that the opposing faces of the collar do not make substantial direct contact with the box.

9. The package according to claim 8, wherein the container has at least one axis of symmetry and the single plane of the collar extends substantially perpendicular to the axis of symmetry.

10. The package according to claim 8, wherein the bisection of the container by the single plane of the collar is visible from a plurality of viewpoints substantially distributed around the outside of the box and within the single plane.

11. The package according to claim 8, further comprising a backing card held within the box, between the container and the box.

12. A decorative package for containing a product, comprising:

an outer transparent box with a hollow interior defined by opposing surfaces, a first box dimension defined between at least two of the opposing surfaces, and a second box dimension defined between at least two other of the opposing surfaces of the box;

a canister removably held in the hollow interior of the box, the canister holding a product and having at least two outer portions that conform to the first box dimension and at least two other portions between which is defined a canister dimension; and a substantially planar decorative collar removably held in the hollow interior of the box;

wherein:

the collar has a perimeter, with at least two portions of the perimeter conforming to the second box dimension;

the collar has a central opening with edge segments that conform to the canister dimension;

the collar is mounted on the canister by interposing the canister between the conforming edge segments of the central opening;

the collar and canister each include a graphic design, and the graphic design on the collar is aligned with and continued by the graphic design on the canister so that a unitary graphic image is created thereby; and the collar holds the canister within a substantially predefined region of the hollow interior of the box.

13. The decorative package according to claim 12, wherein the canister has a body with a lip, and a lid that mounts onto the lip thereby substantially closing the canister, and wherein the collar is mounted on the canister by being placed onto the lip and sandwiched between the body and the lid.

14. The decorative package according to claim 12, further comprising a card held within the box, between at least one of the outer portions of the canister and at least one of the opposing surfaces of the hollow interior of the box.

15. The decorative package according to claim 12, wherein:

the collar is defined by two opposing faces extending between the perimeter of the collar; and the collar is held by the canister so that the opposing faces of the collar do not make substantial direct contact with the box.

* * * * *